United States Patent [19]

Wickwire

[11] 4,071,986

[45] Feb. 7, 1978

[54] BUILDING STRUCTURE

[76] Inventor: Chester F. Wickwire, 90 S. Main St., Homer, N.Y. 13077

[21] Appl. No.: 697,713

[22] Filed: June 21, 1976

[51] Int. Cl.[2] ..... E04B 1/32

[52] U.S. Cl. ..... 52/86; 52/81

[58] Field of Search ..... 52/86–89, 52/80–82

[56] References Cited

U.S. PATENT DOCUMENTS

| | | | |
|---|---|---|---|
| 590,490 | 9/1897 | Thomas | 52/86 |
| 2,297,175 | 9/1942 | Tarran | 52/89 |
| 2,736,072 | 2/1956 | Woods | 52/81 |
| 2,783,721 | 3/1957 | Molke | 52/89 |
| 3,820,292 | 6/1974 | Fitzpatrick | 52/81 |

FOREIGN PATENT DOCUMENTS

| | | | |
|---|---|---|---|
| 972,124 | 8/1975 | Canada | 52/81 |
| 864,353 | 4/1941 | France | 52/86 |
| 1,000,635 | 2/1952 | France | 52/80 |
| 847,531 | 10/1939 | France | 52/80 |
| 1,105,297 | 3/1968 | United Kingdom | 52/67 |

OTHER PUBLICATIONS

Architectural Forum, Apr. 1952, p. 15.
Popular Science, Dec. 1960, p. 113.

*Primary Examiner*—Ernest R. Purser
*Assistant Examiner*—Henry Raduazo
*Attorney, Agent, or Firm*—D. Peter Hochberg

[57] ABSTRACT

A building structure including a pair of opposing flank members having opposing spaced base-edges, upper edges meeting to define a peak of the structure, and convex contours each approximating the shape of a segment of a cylinder whose radius of curvature exceeds one half the base span of the structure. The flanks each comprise a plurality of generally rectangular panels disposed in edgewise abutment, the panels having support walls bordering the interior faces of the panels and having heights sufficient to withstand the stresses at the respective walls. The building structure includes end structures whose configurations are compatible with that of the flank members, and include panels disposed in a variety of edgewise, abutting arrangements.

7 Claims, 9 Drawing Figures

BUILDING STRUCTURE

BACKGROUND OF THE INVENTION

1. Field of the Invention

This invention relates to static structures, and in particular to the construction of self-supporting building structures.

2. Description of the Prior Art

Conventional buildings, including those designed to enclose very large spaces, incorporate a set of interconnected flat, vertical walls which support a roof. Vertical internal support for roofs is generally provided by means of interior vertical walls or columns. In order to provide large, open interior spaces unobstructed by interior supports, resort has been had to generally cylindrical, vertical, exterior walls which support a domed roof, and to a variety buildings which are themselves of dome or vault construction. Folded plate structures such as geodesic domes and the like are also well known in the art as strong and effective buildings. U.S. Pat. No. 3,820,292 describes a particularly strong and economical dome structure which comprises a set of abutting segments, each composed of a plurality of trapezoidal panels of decreasing size, corresponding panels on adjacent segments defining rings of panels.

There are many situations which call for strong, elongate structures enclosing unobstructed interior spaces, and for which dome constructions are not entirely adequate. Elongate buildings are known which include aligned arch-like steel or laminated wood support members over which a generally cylindrical covering fabricated from materials dependent upon the intended use of the building is disposed. Such covering is for example of sheet metal, wood or reinforced concrete construction. Although such buildings are known which are self supporting in that they do not require interior support members, the expense associated with the support members and the foundation for the building render them uneconomical for many applications.

SUMMARY OF THE INVENTION

Figure 1:
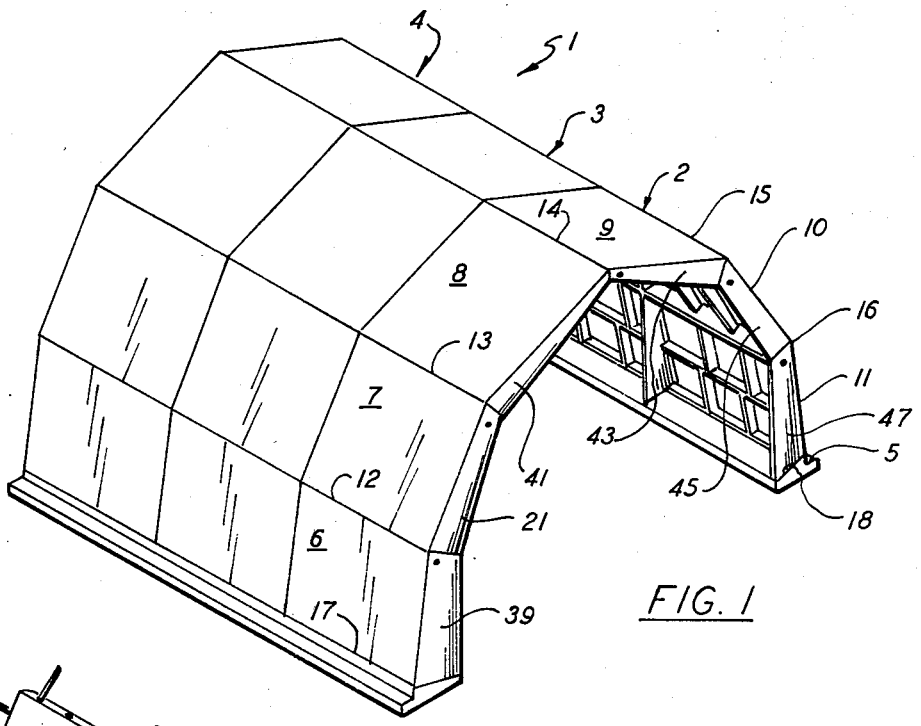
FIG. 1 is a perspective view of an elongated building according to the invention.

It is an object of the present invention to provide a strong, economical building structure.

Another object of the invention is to provide a strong building structure which does not require interior support members.

A further object is to provide a strong elongate building which can be fabricated from lightweight materials.

Still another object is the provision of a self-supporting building of the foregoing type which is susceptible of very large size yet of sufficient strength to resist external forces such as those exerted by wind pressure and snow loads.

It is also an object of this invention to provide an arch construction which is susceptible of fabrication from a plurality of similar panels.

An additional object is to provide a construction of the foregoing type which can be economically constructed using conventional techniques and materials.

Yet another object of the invention is to provide a large, expansive building structure which is susceptible of at least partial pre-fabrication.

Still another object of the invention is the provision of an end structure for an elongated building, which structure is strong, economical to construct, and compatible with elongated panel building constructions.

Other objects will be apparent to those skilled in the art to which the invention pertains from the description to follow and from the appended claims.

The foregoing objects are achieved by the provision of an elongated membrane type building structure including a pair of flank members disposed in an opposing relationship, the flank members having opposing, spaced base edges, and upper edges meeting at a peak of the structure. The flanks comprise a plurality of generally rectangular panels disposed in an edgewise abutting relationship with adjacent panels, with the junctures of the abutting panels being generally parallel to the ground, and bevelled to provide the flanks with configurations approximating segments of cylinders whose radii exceed one-half the base span of the structure. The interior faces of the panels (i.e. the faces on the interior or ground-facing side of the arch) are bordered with support walls. The height of the walls relative to the face of the respective panels can vary in accordance with the magnitude of the stresses at the support walls, these stresses being greatest at the base of the structure and diminishing to their lowest level at the peak of the building. Thus, the support walls extending in the direction transverse to the length of the building can decrease in height from their lower-most location relative to ground towards the peak of the structure, with the support walls at the peak being smallest in height. Each support wall extending in the lengthwise direction is of uniform height, and the height of the latter walls can decrease with the distance of the respective walls from the ground. The ends of the building structure are closed by end structures fabricated from panels and extending from the ends of the elongated building to the ground. The end structures resemble sections of polyhedrons, which in turn approximate rounded structures.

DESCRIPTION OF THE PREFERRED EMBODIMENTS

The preferred embodiment of the invention comprises an elongated building comprising a pair of opposing flanks having opposing spaced base edges and being inclined towards each other to meet at the peak of the structure. The flanks comprise a plurality of rectangular panels which abut adjacent panels at junctures parallel to the ground, the abutting surfaces being bevelled to provide each flank with the convex configuration approximating a segment of a cylinder whose radius of curvature exceeds one-half the base span of the structure. The panels are provided with support walls which increase the edge thickness of the panels, this thickness being sufficient to withstand the compressive and tensile stresses at the junctures of the walls. The support wall height, and hence the edge thickness of the panels, is greatest at the base of the structure, and this height or thickness can decrease with the distance of each wall or portion thereof from the ground. The overall construction provides the arches and the building with substantial strength for resisting external loads and dynamic forces. The building terminates at its end portions in end structures fabricated from panels, and constructed in the general shape of a segment of a polyhedron whose shape approximates a rounded end structure.

Figure 2:
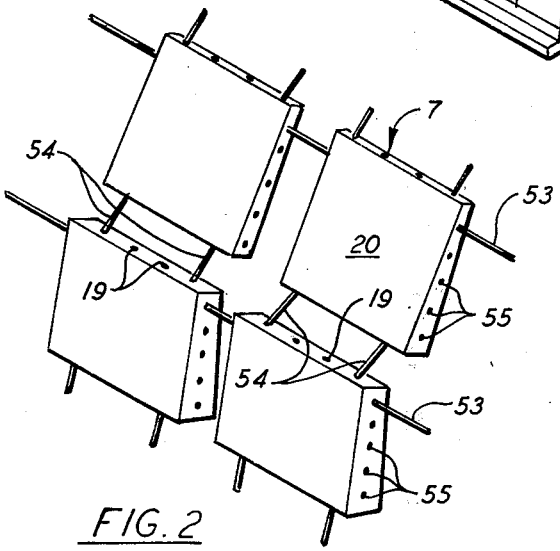
FIG. 2 is an exploded view of a portion of the structure shown in FIG. 1.

Referring now to the drawings, an elongated building 1 according to the invention is shown in FIG. 1. Building 1 is composed of a plurality of identical, juxtaposed arches 2–4 which are mounted on an appropriate foundation 5 disposed on or in the ground. Arch 2, and arches 3 and 4, comprises a plurality of rectangular panels 6–11, which abut at junctures 12–16, respectively. Junctures 12–16 are parallel to the ground. The base edges of the arch, i.e. edge 17 of panel 6 and edge 8 of panel 11, rest on foundation 5. The abutting edges of the panels are secured by means of bolts (not shown) for which bolt holes 19 (FIGS. 2 and 3) are provided.

A force analysis of a structure of the general type shown in FIG. 1 (or of a composite arch), indicates that the weight of the structure imposes significant stresses on the structure. These stresses are negligible at the peak of the building, and greatest at the base, since any horizontal section of the structure in effect carries the weight of the structure above that section. The external loads normally applied to such structures are static loads such the weight of snow, static loads of this type applying stresses which increase from a lowest value at the peak of the structure to a maximum value at the base; and dynamic loads such as wind forces which are generally of a non-uniform nature across the structure.

Structures according to the present invention are designed and constructed to withstand the foregoing loads by translating these loads into virtually purely axial and tensile stresses, and by providing the panels with adequate support to resist those stresses. Bending stresses which are present in many prior art structures are substantially non-existent in structures according to the present invention (aside from some minor secondary bending stresses which may occur at interstices of the panels), so that supplementary support members, common in prior building structures, are not needed to cope with such bending stresses.

Since arch structures as provided by the present invention translate the loads applied to the structure into substantially purely tensile and compressive stresses, these stresses diminishing from a maximum level at the base of the structure to a minimal level at the peak, the panels are constructed to provide maximum strength at the base of the building.

Figure 3:
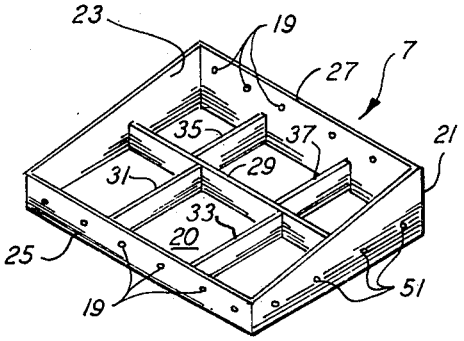
FIG. 3 is a perspective view of a panel used in constructing structures according to the invention.

Accordingly, arches 2–4 are constructed to accommodate small loads at the peak of the arches and substantial loads at the base of the structure. The respective panels which form arches 2–4 are provided with support walls which border the interior faces of the panels. Considering panel 7, for example, FIG. 3 shows this panel to have a face plate 20 to which are secured side support walls 21 and 23 lying in generally parallel planes crosswise of arch 2 and perpendicular to the ground, and end support walls 25 and 27 lying in generally parallel planes lengthwise of arch 2 and perpendicular to side walls 21, 23. In order to withstand the stresses on the structure (which decreases with the height of the structure), the height or depth of walls 21–25 decreases with the distance of the walls from the ground, so that the depth or thickness of the arch is greatest at ground level and smallest at its peak, and increases towards ground level.

Walls 25 and 27 are abutment members for abutting corresponding walls of panels 6 and 8, respectively. The height of wall 27 exceeds that of wall 25 since wall 27 is closer to the ground and further from the peak of arch 2. The height of walls 21 and 23 increases from their respective junctures with wall 25 to their junctures with wall 27, reflective of the varying heights of these side walls with their distance from the ground. The heights of the adjoining walls at the foregoing junctures are equal. Walls 25 and 27 are bevelled relative to the plane of face plate 20 to provide the structure with the quasi-cylindrical configuration referred to herein.

The panels are provided with additional support members to support the panels against buckling. Considering panel 7, these additional members include a central rib 29 extending between side walls 21 and 23, transverse ribs 31–33 extending between central 29 and end rib 25, and transverse ribs 35–37 extending between the central rib and end wall 27.

Figure 4:
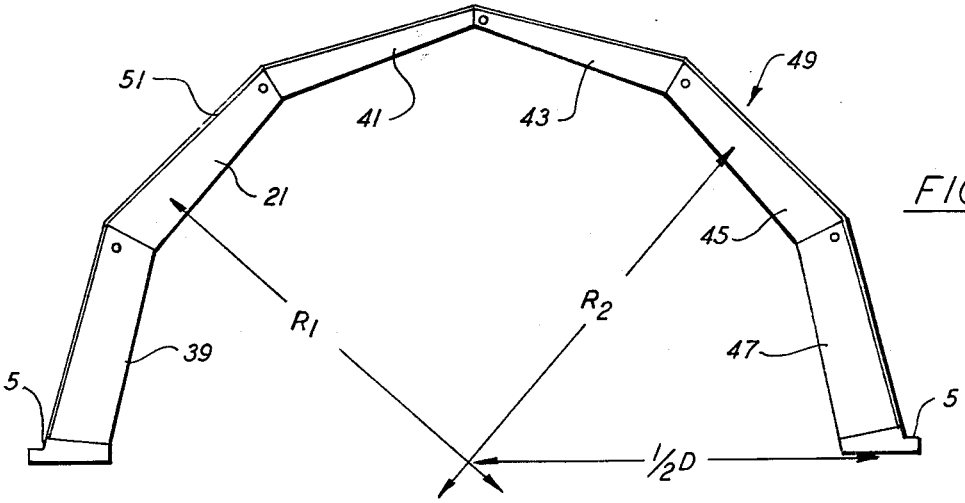
FIG. 4 is an end view of the structure shown in FIG. 1.

The construction of the other panels of building 1 is similar, although the heights of the various support walls vary as indicated to be smallest at the middle of the span of the arch and greatest at the juncture with foundation 5, in accordance with the varying stresses being sustained. The side support walls visible in FIG. 1 for panels 6–11 are 39, 21, 41, 43 and 45, respectively. The heights of these walls at their junctures are equal so that these side support walls collectively form a generally continuous arch, as indicated in FIGS. 1 and 4.

The height of the support at edges 17, 18 must be sufficient to sustain the maximum stress in the structure. The other support walls can decrease in height in accordance with the reduced stresses present at higher parts of the structure. However, for convenience of manufacture, it may in some situations prove advantageous that the panels be generally identical in construction, with all of the support walls being of uniform height. This height must at least be sufficient to sustain the stresses present at the respective walls.

Since building 1 and its composite arches have no interior support members, it is important that the building have sufficient strength to oppose the loads tending to fold or collapse the structure. Such strength is achieved by providing building 1 and its composite arches with the endwise profile shown in FIG. 4. The structure may be seen to comprise opposing flanks 49 and 51 which meet at the juncture 14, juncture 14 also being the peak of arch 2; and descend therefrom to foundation 5. The contours of the flanks each approach the contour of a segment of a cylinder. However, the centers of curvature of the two opposing flanks (or more accurately of the segments of the cylinders whose shape they approach) are spaced from each other. More particularly, the radii of curvature $R_1$ and $R_2$ of each flank exceed one half the base diameter ($\frac{1}{2}$ D) or base span of arches 2–4 and building 1. The foregoing construction avoids the tendency which might exist for the structure to fold, because bending stresses are avoided at the junctures between the respective panels. The flanks are symetrical about a central plane perpendicular to ground and extending through the peak of the structure. The opposing flanks in effect lean against each other, with the horizontal forces exerted by each flank being equal and any tendency of the structure to collapse under its weight being negated. The convex, quasicylindrical configuration of flanks 49 and 51 is effected by means of the previously mentioned bevel provided at the abutting surfaces extending in the direction of the length of building 1.

In order to connect adjacent arches together, appropriate connectors such as bolts or cables 53 (FIG. 2) can be used. Holes 55 are provided in the side support walls of the various panels for receiving the connectors. In addition, a plurality of cables 54 can be provided for anchoring building structure 1 to the ground, such as in those situations wherein the structure is to be subjected to significant wind forces. Cables 54 are advantageously connected to foundation 5 by means of appropriate eye bolts or the like embedded in the foundation, and run through selected holes 19 in aligned panels forming a flank of each arch, through similar holes at the peak of the structure, and down the opposite flank of the arch for connection to the foundation.

In practice, elongated building structures have been found very practicable to construct whose span between the interior base edges of the opposing flanks ranges from 50 to 132 feet, and whose radii of curvature of the segments of the cylinder which the respective flanks approximate is on the order of 150 feet. Furthermore, it has been found effective to orient the panels in the respective flanks in given arches so that the exterior planes of adjacent panels intersect at an angle of approximately 3°, as established by the above-mentioned bevelled abutting surfaces.

Figure 5:
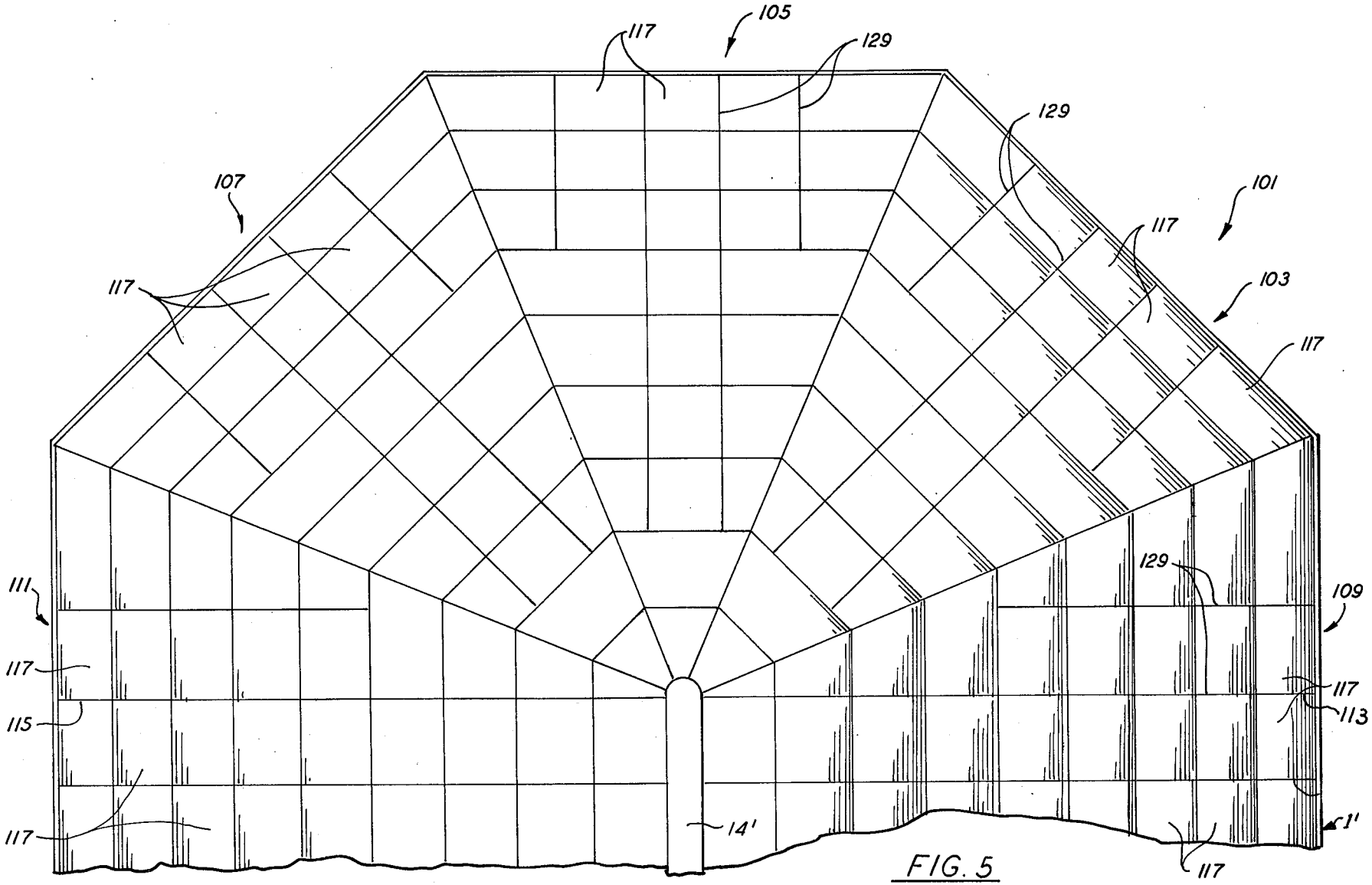
FIGS. 5 and 6 are top and side views of an embodiment of an end construction for a building of the type shown in FIG. 1.
Figure 6:
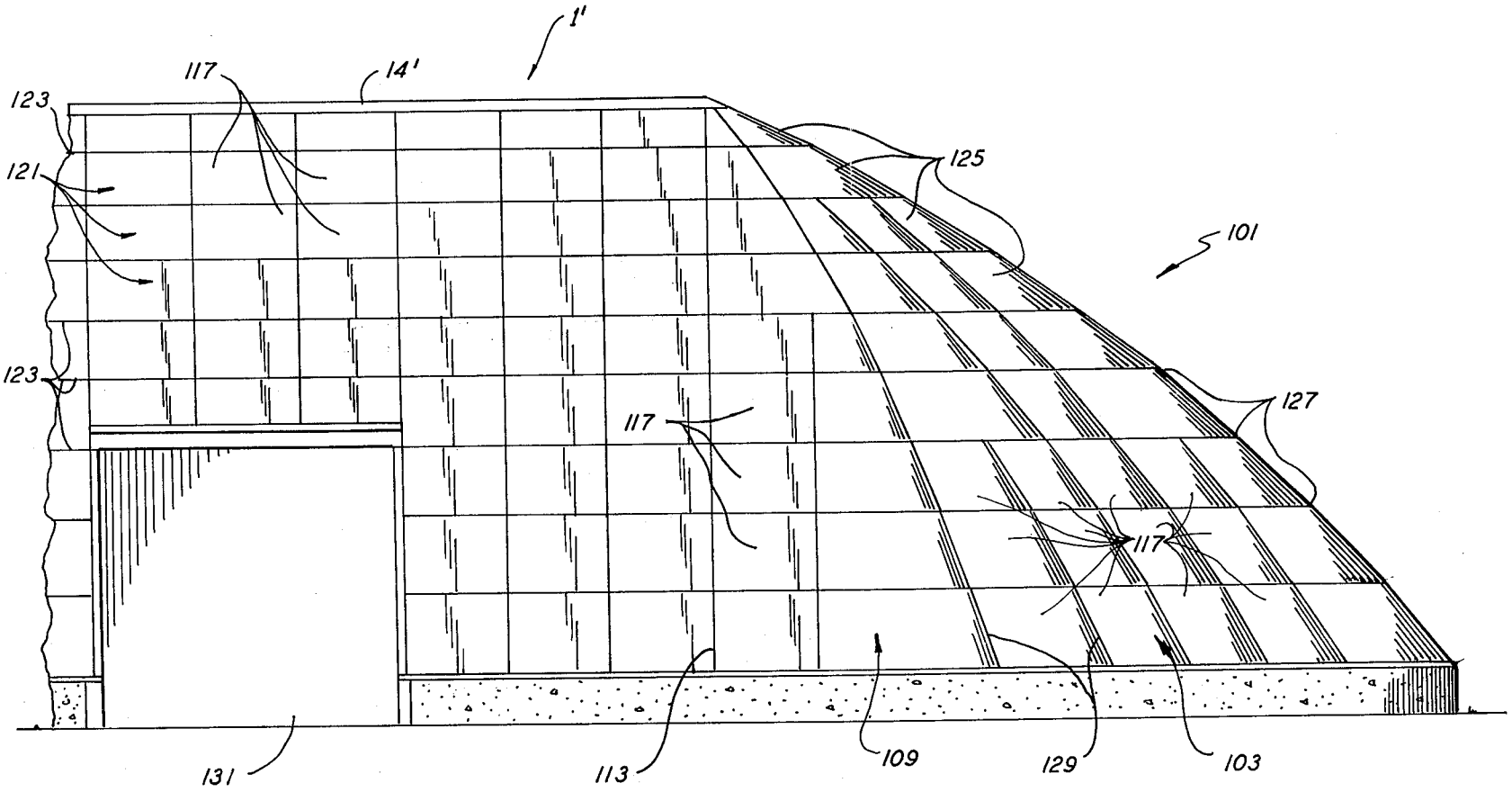

For most applications of elongated building structures of the type described above, it is desirable to provide end structures for closing the open ends of the elongated building to define an enclosed interior space of the building. One such end structure which is particularly compatible with elongated building structures as described herein is shown in FIGS. 5 and 6. The elongated building itself is designated by the numeral 1', and is similar to the building shown in FIG. 1 although each arch comprises a larger number of panels. Building 1' comprises opposing flanks which join at a peak covered by a metal cap 14'. The cap functions primarily to prevent precipitation from flowing into the juncture of the flanks. The end structure for building 1' is designated by the numeral 101. End structures according to the invention comprise one half of a polyhedron whose horizontal cross-section is a regular polygon (an equilateral, equiangular figure). End structure 101 basically comprises one half of an eight-sided polyhedron, and includes a set of sections which are multi-faceted and convex. The cross-section of structure 101, and especially its base (FIG. 5), comprises one half of a regular octagon. Structure 101 includes full polyhedral sections 103, 105 and 107, and half polyhedral sections 109 and 111. Sections 109 and 111 terminate in coplaner surfaces 113 and 115 which interface corresponding surfaces of building structure 1'.

End structure 101 is constructed from a plurality of panels similar to panel 7 shown in FIG. 3, each panel thus including a face panel, support walls bordering the interior side of the face panels and extending perpendicularly from the face panel, and support ribs adding rigidity to the face panel and additional support to the support walls. For reasons of convenience and economy, to the extent possible, the panels from which end structure 101 is constructed are similar or identical to the panels forming building structure 1'. In this regard, building 1' is constructed from substantially identical panels whose support walls bordering each face panel are of uniform height, this height being sufficient to withstand the maximum loads to which any panels would be subjected. Accordingly, panels 117 in building structure 1' and end portion 101 are identical in dimensions and construction. This arrangement greatly facilitates the prefabrication and storage of such panels. The remaining panels of which end structure 101 is comprised are configured according to the shape of the portion of the polyhedron section of which they form a portion. Examination of these panels in FIG. 5 indicates that they are generally four sided figures having unequal opposing parallel sides, and unequal non-parallel sides connecting the ends of the parallel sides. The panels at the peaks of the the respective sections are of a triangular configuration.

End structure 101 is designed and constructed to be a continuous extension of building structure 1', and is constructed to have the same strength charactistics as the elongated building structure. With regard to the continuity, building structure 101 can be considered as including a plurality of juxtaposed arches, the arches collectively defining horizontal rows 121 of panels. The panels in each row 121 are generally co-planer, and their plane is transverse to horizontal planes defining the junctures of each row with adjacent rows (ignoring the presence of the bevel between the rows). Adjacent rows of panels abut to form parallel rows of ridges 123 running the length of building structure 1'. End structure 101 is constructed so that it too includes rows of panels 125 which intersect at ridges 127, the latter rows and ridges being extensions of rows and ridges 121 and 123 of building structure 1'. Rows 125 and ridges 127 are curved and connect the corresponding rows and ridges in the opposite flanks forming structure 1', as shown in FIG. 5.

The static loads to which end structure 101 is subjected, such as the weight of the building and snow loads, are translated into purely axial and tensile stresses which the building is constructed to sustain, and bending stresses are substantially nonexistent for the reasons explained with regards to the elongated building. Sections 103–111 forming end structure 101 are each comprised of subsections formed from generally aligned columns of abutting panels, each column extending from the base of the structure towards the peak thereof, this peak being the end of the intersection of the flanks forming structure 1'. The adjacent columns of end structure 101 meet at junctures designated generally by the numeral 129. These junctures 129 are of varying lengths depending upon the location of the particular juncture in each section. It is significant that the entire end structure 101, and the various polyhedral sections and columns of panels therein, are of a convex configuration. Such convex configuration in effect prevents end structure 101 from collapsing under loads to which it would be subjected. End structure 101, and a like end structure at the opposite end of building 1', lean against the building structure, whereby the entire building is in static equilibrium and the component portions reenforce each other. Therefore, the building is extremely strong despite the lack of internal supports. End structure 101 is unlike the domed structure disclosed in U.S. Pat. No. 3,820,292 referred to earlier, in that the end structure of the present invention is not constructed from wedge shaped sectors whose profiles are calculated according to the critical curve criteria disclosed in that patent.

There may be situations in which it becomes desirable to incorporate cross members interconnecting the opposing flanks of the elongated building structure described above, as well as opposing portions of end structure 101. This might be desirable, for example, on particularly large buildings, on buildings subjected to high dynamic loads, and in cases where loft space is desired. The building described herein can easily be modified to incorporate such cross members. Access to the building described above can be provided by many means, and the structure shown in FIG. 6 includes a large entranceway 131 for this purpose.

Figure 7:
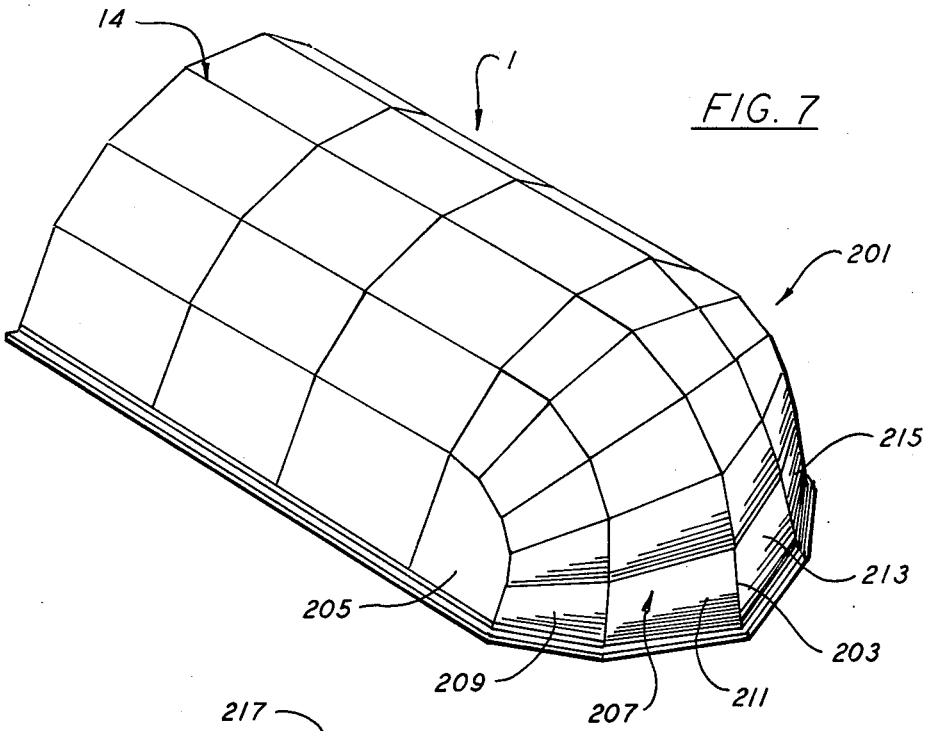
FIG. 7 is a perspective view of another embodiment of an end construction for a building of the type shown in FIG. 1.

An alternate end structure for building 1 is shown in FIG. 7 and is designated by the number 201. End structure 201 has a dome-like configuration and includes a plurality of wedge shaped segments which extend from a central peak or ridge 203 (representing an extension of peak 14 of building structure 1) to opposed, identical end plates 205. End structure 201 approximates a quarter of a sphere commencing from a plane defined by the end surfaces of building structure 1 and terminating at ground. However, each half of structure 201 as defined in part by a plane through ridge 203 perpendicular to ground, has a radius of curvature exceeding one half the span of end structure 201, so it would be more accurate to state that the shape of structure 201 approximates a pair of abutting portions of identical spheres, each portion being slightly less than one eighth of the spheres from which they are taken. This end structure comprises a plurality of trapezoidal panels 207. Panels 207 each include opposed pairs of unequal parallel sides which are parallel with ridge 203, and equal non-parallel sides connecting the parallel sides. The panels forming end structure 201 are arranged in rows 209, 211, 213 and 215. These rows are in effect extensions of corresponding rows of panels in building structure 1. Each row 209–215 is comprised of panels 207 which are arranged so that their non-parallel sides are in abutting relationships with non-parallel sides of adjacent panels. Therefore, each row in effect forms a half of an arch extending from building structure 1 to ground. The rows slope towards ground both from building structure 1 and from peak 203. The long, parallel sides of panels 207 in row 209 abut the short parallel sides of panels 207 in row 211, these abutting sides being of equal length. The panels in rows 213 and 215 have a similar relationship. The equal, long parallel sides of adjacent panels abut at the central ridge or peak 203 of end structure 201.

Figure 8:
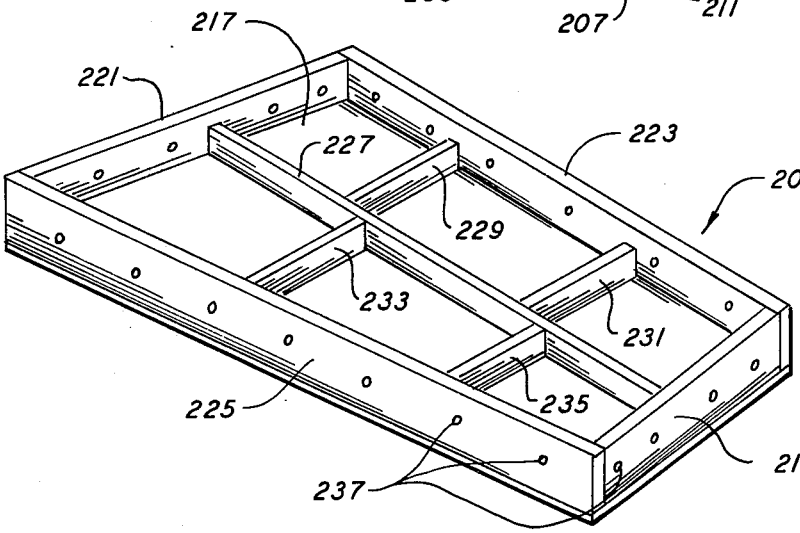
FIG. 8 is a perspective view of a panel used in constructing the building end shown in FIG. 7.

Panels 207 are constructed in a manner similar to panels previously described, and referring to FIG. 8 may be seen to include a face plate 217 from which extend parallel support walls 219 and 221, these walls being coextensive in length with the parallel sides from which they extend. Non-parallel side walls 223 and 225 extend along the non-parallel sides of panel 207 and interconnect the parallel support walls. A central rib 227 interconnects walls 219 and 221, and ribs 229–235 extend transversely from rib 227 to the non-parallel support walls. Support walls 221–225 strengthen the panel and provide abutment surfaces to which corresponding surfaces of adjacent panels can be attached, and interior support ribs 227–235 add strength and rigidity to face plate 217. A plurality of holes 237 are provided for receiving bolts or other connectors for connecting the various panels together. The abutment surfaces of the trapezoidal panels are preferably bevelled to assure a strong interface between adjacent panels and to facilitate the desired configuration of end structure 201.

Figure 9:
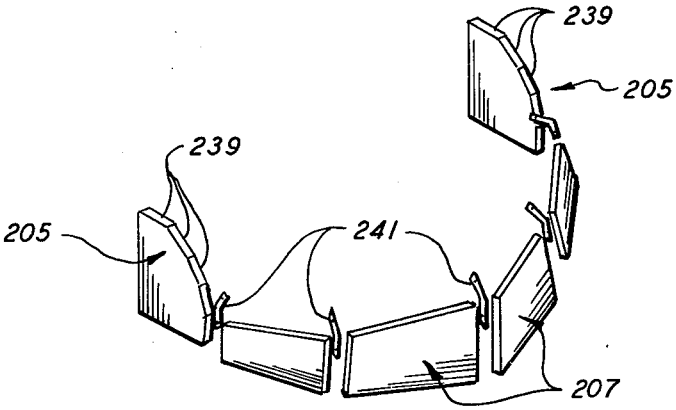
FIG. 9 is a detailed exploded view of the base of the end construction shown in FIG. 7.

End plates 205 approximate quarters of a circle whose radius equals the height of the panel in building structure 1 which they respectively abut. End plates 205 further include a series of planer portions 239 (FIG. 9) which are abutted by the shorter, parallel sides of panels 207 in rows 209 and 215 respectively. End structure 201 is extremely strong, largely because of the folded plate construction employed. Structure 201 is convex in many directions, and can sustain substantial loads without collapsing. Since structure 201 is in effect bowed in two directions, the compressive stresses on the structure are divided, thus reducing the stresses in a single direction; therefore, the panels can be selected to sustain lesser stresses in any direction. The structure is very compatible with the elongated building structure 1, and similar construction techniques can be employed for both the building structure and the end structure, greatly facilitating the construction of the building. In order to add further strength to end structure 201, and to the other structures described herein, flitch plates 241 (FIG. 9) can be incorporated at the junctures of adjacent panels.

A pair of end structures 201 could be employed at opposite ends of building structure 1 to both provide an enclosed space, and to further strengthen the building structure and the other end structure. It is not necessary that identical end structure be incorporated at opposite ends of building structure 1, and circumstances could dictate that different end structures be used.

It is significant that end structure 201 is itself a self-supporting structure, and could be used as a building structure by itself. Hence, although it is described as an end structure, it is not restricted to such function.

The preferred embodiments described herein fulfill the objects of the invention. A large, expansive, self-supporting building structure has been disclosed which can economically be constructed from readily available, lightweight materials. The panels forming the structure are very susceptible of prefabrication. The elongated building and the end structures provided herein are very strong, and adaptable for many uses.

The invention has been described with particular reference to the preferred embodiments, but it will be understood that variations and modifications within the spirit and scope of the invention may occur to those skilled in the art to which the invention pertains.

I claim:

1. An elongated building structure comprising:

a pair of flank members disposed in an opposing relationship and being generally identical in configuration and orientation, the flank members having opposing base edges spaced from each other and defining the base span of the structure, upper edges meeting to define a peak of the structure, convex contours each approximately the shape of a segment of a cylinder whose radius of curvature exceeds one half of said base span, and being symmetrical about a central plane including said peak and being perpendicular to ground, and having co-planar end surfaces defining an open end to said flank members, said flank members each comprising:

a plurality of generally rectangular panels, the panels being disposed in edgewise abutment with adjacent panels at junctures parallel to each other and to ground, the abutting surfaces being bevelled to cause the abutting panels to collectively define an outward convexity in the flanks; said panels including rigid, planar face plate members defining exterior and interior surfaces of said structure, and support walls perpendicular to and bordering the interior surfaces of the face plate members, said support walls having heights at least sufficient to withstand tensile and compressive stresses existing at the respective support walls; and an end structure closing the open end of said flank members, said end structure comprising:

a set of sections collectively approximating one half of a polyhedron whose cross section is one half of a regular polygon, two of said sections having exterior surfaces extending from the exterior surfaces of said elongated building at said open end towards said central plane, all of said sections being juxtaposed collectively forming a continuous surface connecting the exterior surfaces of said flanks; each of said sections extending from a common juncture at an end of said peak to a base at the ground, and comprising trapezoidal panels and a plurality of rectangular panels, the rectangular panels having generally side walls bevelled to abut corresponding side walls of adjacent panels to provide each section with a convexity generally equal to the convexity of said arches.

2. The invention according to claim 1 wherein the height of said support walls diminishes from a maximum value at said base edge to a minimum value at said peak, in accordance with the corresponding reduction in axial and tensile stresses in said structure.

3. The invention according to claim 1 wherein said panels further include support ribs extending between said support walls.

4. The invention according to claim 1 wherein said polyhedron is one half of an eight-sectioned body whose horizontal cross-section is one half of a regular octagon, said two sections comprising half sections of said eight-sectioned body, and the remaining sections forming said end structure comprising full sections of said eight-sided body.

5. An elongated building structure comprising:

a pair of flank members disposed in an opposing relationship and being generally identical in configuration and orientation, the flank members having opposing base edges spaced from each other and defining the base span of the structure, upper edges meeting to define a peak of the structure, and convex contours each approximately the shape of a segment of a cylinder whose radius of curvature exceeds one half of said base span, and being symmetrical about a central plane including said peak and being perpendicular to ground, and having co-planar end surfaces defining an open end to said flank members, said flank members each comprising:

a plurality of generally rectangular panels, the panels being disposed in edgewise abutment with adjacent panels at junctures parallel to each other and to ground, the abutting surfaces being bevelled to cause the abutting panels to collectively define an outward convexity in the flanks; said panels including rigid planar face plate members defining exterior and interior surfaces of said structure, and support walls bordering the interior surfaces of the face plate members, said support walls having heights at least sufficient to withstand tensile and compressive stresses existing at the respective support walls; and an end structure closing the open end of said flank members, said end structure comprising:

a plurality of rows of panels extending from said end surfaces, said panels in said end structure comprising trapezoidal panels each having a long parallel side and a short parallel side opposite the long parallel side, and non-parallel sides connecting the corresponding ends of said long and short parallel sides; each row comprising a plurality of said trapezoidal panels oriented in a like manner with their non-parallel sides in an abutting relationship with corresponding non-parallel sides of adjacent panels, and the long and short parallel sides of the rows being disposed in parallel planes parallel with said central plane; said rows being juxtaposed and diminishing in size from a peak and sloping outwardly and downwardly from said peak.

6. The invention according to claim 5 wherein the trapezoidal panels forming said rows are arranged to form juxtaposed columns of panels extending downwardly and outwardly from said peak, said columns comprising pluralities of said trapezoidal panels arranged with the parallel sides of the panels disposed in an abutting relationship with the parallel sides of adjacent panels, the abutting parallel sides being of equal length, and the non-parallel sides of adjacent panels being aligned and disposed in planes defining the boundaries of the respective columns.

7. The invention according to claim 6 and further including opposing end plates, each each end plate being parallel to the parallel sides of said trapezoidal panels and including a plurality of planar edges for engaging the short parallel side of the trapezoidal panels at the ends of said columns of trapezoidal panels.

* * * * *